US005796379A

United States Patent [19]

Enomoto et al.

[11] Patent Number: 5,796,379

[45] Date of Patent: Aug. 18, 1998

[54] DIGITAL DATA LINE DRIVER ADAPTED TO REALIZE MULTIGRAY-SCALE DISPLAY OF HIGH QUALITY

[75] Inventors: Hiromi Enomoto; Hirokazu Miwa; Hiroyuki Isogai, all of Kawasaki, Japan

[73] Assignee: Fujitsu Limited, Kawasaki, Japan

[21] Appl. No.: 631,615

[22] Filed: Apr. 10, 1996

[30] Foreign Application Priority Data

Oct. 18, 1995 [JP] Japan ..... 7-270228

[51] Int. Cl.[6] ..... G09G 3/00

[52] U.S. Cl. ..... 345/89; 345/98; 345/100; 345/147

[58] Field of Search ..... 345/89, 100, 98, 345/147

[56] References Cited

U.S. PATENT DOCUMENTS

| | | | |
|---|---|---|---|
| 5,337,070 | 8/1994 | Kitajima et al. | 345/98 |
| 5,363,118 | 11/1994 | Okumura | 345/89 |
| 5,414,443 | 5/1995 | Kanatani et al. | 345/89 |
| 5,447,234 | 9/1995 | Suzuki et al. | 35/98 |
| 5,638,091 | 6/1997 | Sarrasin | 345/147 |

FOREIGN PATENT DOCUMENTS

| | | |
|---|---|---|
| 728033 | 1/1995 | Japan . |
| 85104437 | 4/1996 | Japan . |

*Primary Examiner*—Richard A. Hjerpe
*Assistant Examiner*—Tracy H. Nguyen
*Attorney, Agent, or Firm*—Greer, Burns & Crain, Ltd.

[57] ABSTRACT

A digital data line driver includes a data input circuit for fetching data in response to an external clock, a reference voltage supply circuit having reference voltages corresponding to a plurality of gray-scale levels, a selector circuit for selecting a specified reference voltage representing the data from among those of the reference power supply circuit, and an output circuit for outputting the reference voltage selected by the selector circuit as display data onto data lines. The data input circuit and output circuit have a data-crossing function for switching data between adjoining channels of the data lines according to an external data switching control signal. Owing to this configuration, deterioration of liquid crystal can be prevented and a better display can be attained with suppressed flickers. At the same time, the picture-frame space can be reduced.

10 Claims, 17 Drawing Sheets

Fig. 8

| DATA | (R/L, POL) (0, 0) | (0, 1) | (1, 0) | (1, 1) |
|---|---|---|---|---|
| ③ | RR1 (R1) | RR2 (G1) | LL4 (R2) | LL5 (G2) |
| ③ | RR2 (G1) | RR1 (R1) | LL5 (G2) | LL4 (R2) |
| ③ | RR3 (B1) | RR4 (R2) | LL6 (B2) | LL1 (R1) |
| ④ | RR4 (R2) | RR3 (B1) | LL1 (R1) | LL6 (B2) |
| ④ | RR5 (G2) | RR6 (B2) | LL2 (G1) | LL3 (B1) |
| ④ | RR6 (B2) | RR5 (G2) | LL3 (B1) | LL2 (G1) |

GRAY-SCALE LEVEL VOLTAGE
<POSITIVE>
<NEGATIVE>
VR32 (VA16)
VR31 (VA15)
VR16 (VB16)
VR15 (VB15)
VR30 (VA14)
VR29 (VA13)
VR14 (VB14)
VR13 (VB13)
(VA12)
(VA11)
(VB12)
(VB11)
(VA10)
(VA09)
(VB10)
(VB09)
(VA08)
(VA07)
(VB08)
(VB07)
(VA06)
(VA05)
(VB06)
(VB05)
VR20 (VA04)
VR19 (VA03)
VR04 (VB04)
VR03 (VB03)
VR18 (VA02)
VR17 (VA01)
VR02 (VB02)
VR01 (VB01)
Q1
Q2
Q3
Q4
20
REFERENCE VOLTAGE INPUT
V9
V8
V7
V6
V5
V4
V3
V2
V1
V0
POSITIVE
NEGATIVE

DIGITAL DATA LINE DRIVER ADAPTED TO REALIZE MULTIGRAY-SCALE DISPLAY OF HIGH QUALITY

BACKGROUND OF THE INVENTION

1. Field of the Invention

The present invention relates to a liquid-crystal display (LCD) or, more particularly, to a digital data line driver adapted to realize a multigray-scale display of 64 levels or the like when a liquid-crystal panel to be incorporated in the LCD is driven from single bank.

An active matrix type LCD represented by a liquid-crystal panel of a thin-film transistor (TFT) type is expected to prevail as a display for general home TV or office-automation equipment. This is attributable to the fact that the active matrix type LCD is thinner and lighter than a cathode-ray tube (CRT) and can provide display quality that compares favorably with that of the CRT. By making the most of the merits that the active matrix type LCD is thin and lightweight, the active matrix type LCD is expected to cope not only with portable information equipment such as notebook type personal computers but also with multimedia information equipment or the like.

2. Description of the Related Art

A liquid-crystal panel for an active matrix type LCD has a structure in which liquid crystal is injected between opposed electrode substrates. To be more specific, on one of the substrates, electrodes (signal electrodes) on a data bus including a plurality of data lines, and electrodes (scan electrodes) on a scan bus including a plurality of scan lines intersect in the form of a matrix, and a switching device such as a TFT is connected to each of the intersections (this substrate is referred to as a TFT substrate). On the opposite substrate, an electrode is formed all over the surface (this substrate is referred to as a common substrate).

For driving the foregoing LCD, a voltage is applied between the TFT substrate and common substrate. In other words, a data voltage corresponding to a video signal is applied to the signal electrodes (data lines) on the TFT substrate. TFTs connected to a selected scan line in the scan bus are turned on consecutively. Thus, potential differences between the data voltage applied to associated data lines and a common voltage on the common substrate are charged in associated pixels. The charges are retained until the line (scan line) is selected next, whereby data is retained. Voltages to be applied to that part of the liquid crystal are determined according to the retained data. An amount of transmitted light is controlled accordingly. Consequently, a gray-scale display can be attained. For realizing color display, color filters of red (R), green (G), and blue (B) are used to separate or synthesize colored light.

Circuits for driving the LCD include a scan line driver for driving the scan lines, a data line driver for driving the data lines, and a common voltage circuit. When the scan line driver selects a scan line, a data voltage corresponding to a video signal is applied to the pixels connected onto the scan line over the data lines. In an LCD, generally, when a data voltage of the same polarity is continually applied to the same pixel, the service life of the LCD is adversely affected. In an effort to prevent this phenomenon, driving voltages of positive and negative polarities are applied alternately in every cycle (one frame cycle or one horizontal cycle). This is referred to as "alternating drive." This alternating drive causes flickers in a screen. For suppressing the flickers, polarity inversion is carried out for each data line. For example, a method in which driving voltages of opposite polarities; positive and negative polarities are applied to next data lines and thus voltages of opposite polarities are applied to next pixels is adopted. This driving method is referred to as "vertical line inversion" drive.

FIG. 1 shows the configuration of a typical data line driver.

The illustrated driver comprises a shift register circuit 51, a data register circuit 52 and latch circuit 53 each having a storage capacity of the number of bits constituting digital display data Dn, a decoder circuit 54, a selector circuit 55 composed of a group of analog switches, and a gray-scale level voltage generation circuit 56. The driver is controlled by a clock CLK, a start signal ST indicating state of data fetch, and a latch signal LP indicating the timing of switching outputs.

First, the shift register circuit 51 starts operating in response to the start signal ST supplied for each display line (each horizontal cycle), shifts the start signal ST on application of each pulse of the clock CLK, and produces a timing signal. In response to the timing signal, the data register circuit 52 fetches the digital display data Dn successively. After the data is fetched into the data register circuit 52, before data for the next one line comes, the latch circuit 53 fetches the data from the data register circuit 52 in response to the latch signal LP. The decoder circuit 54 then decodes the digital data retained in the latch circuit 53. Based on the results of decoding, the selector circuit 55 selects and outputs one of a plurality of gray-scale level voltages (in the illustrated example, 64 gray-scale level voltages) generated by the gray-scale level voltage generation circuit 56. The selected gray-scale level voltage is sent as a driving voltage to channels (data lines Q1 to Q192).

The gray-scale level voltage generation circuit 56 is, for example, as shown in FIG. 2, realized in the form of a resistor array type D/A converter. In the illustrated example, 64 resistors are each used to tap nine lines of reference voltages V0 to V8 that are input as reference voltages; that is, to lines of reference voltages V0 and V1, lines of reference voltages V1 and V2, etc., and lines of reference voltages V7 and V8 into eight lines respectively. Thus, 64 gray-scale level voltages of V0, and VR01 to VR63 are produced. One of the produced 64 gray- scale level voltages is, as mentioned above, selected by an analog switch in the selector circuit 55 controlled by the decoder circuit 54.

FIGS. 3A and 3B show the locations of data line drivers or a data line driver (for dual bank driving and single bank driving) relative to a liquid crystal panel. Reference numeral 100 denotes a typical liquid-crystal panel.

For dual bank driving, a scan line driver is located on either of the right and left sides of the liquid-crystal panel 100. A data line driver is located on each of the upside and downside of the liquid-crystal panel 100. In this case, the data line drivers are arranged so that their output lines (data lines) can be arranged in the form of a comb. In this layout, if the polarity of a driving voltage supplied from the upside data line driver is opposite to that of a driving voltage supplied from the downside data line driver, "vertical line inversion" driving is achieved. Data voltages of opposite polarities can therefore be applied to pixels adjoining in a lateral direction (direction of a scan line). This makes it possible to suppress flickers in a screen. Moreover, the alternating drive in which polarities are changed frame by frame makes it possible to prevent deterioration of a liquid crystal.

In contrast, for single bank driving, the location of a scan line driver is the same as that for dual bank driving, but a data line driver is situated on either of the upside and downside of the liquid-crystal panel 100. In this single bank driving, for realizing vertical line inversion drive, it is required to invert display data channel by channel for each data line before supplying the data. The function of data inversion may be implemented in a dedicated means to be installed externally to the driver or implemented internally in the driver. FIG. 3B shows an example of the latter implementation. Compared with the dual bank driving, the single bank driving has the advantage that a remaining portion (so-called picture-frame area) of a whole LCD after excluding an area in which the liquid-crystal panel 100 is mounted can be made smaller.

In single bank driving, when the data inversion function is implemented in a driver, the driver must be configured so that a positive-polarity driving voltage and negative- polarity driving voltage can be output over both an odd channel and even channel in an output port of the driver. An example of the configuration realizing this method of outputting is shown in FIG. 4.

FIG. 4 shows the configuration (arrangement of gray-scale level voltage lines) of a major section of a data line driver for a known LCD.

As illustrated, an even number of reference voltages are input externally (in the illustrated example, ten voltages V0 to V9), and are divided into two groups each of which consists of five reference voltages and which are positive voltages and negative voltages that are symmetrical with respect to a center voltage. Four resistors are used to tap adjoining lines of reference voltage (for example, voltages V5 and V6) into four lines, whereby gray-scale level voltages (VR17 to VR20) corresponding to four gray- scale levels (VA01 to VA04) are produced. Herein, a difference of each gray-scale level voltage from a center voltage between the groups of reference voltages is regarded as a display gray-scale level. In the illustrated example, gray-scale level voltages corresponding to 16 gray-scale levels are produced in each of the positive and negative directions. One of the positive gray-scale level voltages VR17 to VR32 is selected by an analog switch in the selector, and sent to an associated odd channel (any of data lines Q1, Q3, etc.). Likewise, one of the negative gray- scale level voltages VR01 to VR16 is selected by an analog switch in the selector and sent to an associated even channel (any of data lines Q2, Q4, etc.).

As is apparent from the configuration shown in FIG. 4, gray-scale level voltage lines for transmitting gray-scale level voltages produced by the voltage dividers realized by the resistors are laid down throughout the circuits of all the channels. When the circuits are observed in units of a channel, a specified gray-scale level voltage sent over a gray-scale voltage line and selected by an analog switch is output by way of a line extending from the switch to an output pad.

One of the future prospects of technological development concerning an LCD is an enlarged display area of a liquid-crystal panel and a diminished picture-frame space. Regarding the picture-frame space, it is preferred that an area occupied by drivers (especially by a data line driver) should be made smaller. For this purpose, as shown in FIG. 3B, it is advantageous to install a data line driver single bank.

However, for single bank driving, as described in conjunction with FIG. 4, in order to realize vertical line inversion drive, a driver must be configured so that a positive-polarity driving voltage and negative-polarity driving voltage can be output to each channel (odd channels and even channels) in an output port of the driver. For this purpose, it is required to double the number of reference voltages or analog switches (in other words, 32 gray-scale level voltages must be produced in order to attain 16 gray-scale levels). As a result, there arises a problem that the scale of a gray-scale level voltage generation circuit or selector circuit in the driver gets larger. This leads to an increase in scale of the circuitry of the whole driver and eventually to an expansion of a picture-frame space, and is therefore unfavorable.

As another technique for realizing vertical line inversion drive in single bank driving mode, it is conceivable that the number of reference voltages employed conventionally is equally divided into positive voltages and negative voltages.

However, this technique is unfavorable from the viewpoint of realization of better display because the number of display gray-scale levels is halved.

In the conventional data line driver, as shown in FIG. 4, the gray-scale level voltage lines for transmitting gray-scale level voltages are arranged throughout the circuits of all channels. When the circuits are observed in units of a channel, a specified gray-scale level voltage sent over a gray-scale level voltage line and selected by an analog switch is output by way of an output line from the point of the analog switch. This poses the problems described below.

That is to say, since the length of an output line (distance from a point at which a gray-scale level voltage is selected to an output pad) is not constant among gray- scale levels, and the resistance of an line layer is not 0, a problem that there is a difference in line resistance between gray-scale levels takes place. This problem becomes more obvious, especially, when a narrow line layer or a line layer with a large resistance is employed.

Referring to FIG. 4, it can be seen that the gray-scale level voltage lines are divided into a positive group and negative group with respect to a center voltage (Vc) and arranged orderly according to their voltage levels. However, since the positions of lines of positive and negative voltages corresponding to the same gray-scale level (for example, voltages VA16 and VB16) are separated from each other, there is a difference between distance of associated analog switches from associated output pads; that is, a difference in length between output lines. As a result, the line resistances differ from each other. An output resistance differs between the lines of positive and negative voltages corresponding to the same gray-scale level. When a sum (R) of an output resistance and data line resistance, and a load capacitance (C) of a liquid-crystal panel are taken into consideration as a whole, a time constant determined with the product CR differs between the lines of positive and negative voltages corresponding to the same gray-scale level. The same applies to the other gray- scale levels.

As long as a sufficiently long time interval can be preserved as the driving time for a liquid-crystal panel, no problem occurs. In case the driving time is limited due to application to high-definition display or multigray-scale display, when a sufficient charging time cannot be preserved, even if positive and negative reference voltages input to a driver have the same level (for example, $V9-Vc=V4-Vc$), as shown in FIGS. 5A and 5B, positive-polarity and negative-polarity voltages va and vb to be applied to pixels during the same time interval are different from each other ($va \neq vb$). This results in a problem that gray-scale level voltages corresponding to each gray-scale level differs from each other, and a variation between gray-scale levels therefore increases.

In FIGS. 5A and 5B, for example, va16 denotes a voltage to be applied to a pixel according to a potential difference of a gray-scale level voltage VR32 corresponding to a gray-scale level VA16 from the center voltage Vc. Likewise, vb16 denotes a voltage to be applied to a pixel according to a potential difference of a gray-scale level voltage VR16 corresponding to a gray-scale level VB16 from the center voltage Vc.

In the arrangement of gray-scale level voltage lines shown in FIG. 4, intersections between output lines of odd channels and negative gray-scale level voltage lines, and intersections between output lines of even channels and positive gray-scale level voltage lines are unoccupied spaces in terms of circuitry (in other words, are devoid of analog switches). This poses a problem that when a driver is realized in the form of an IC, the chip size increases.

SUMMARY OF THE INVENTION

An object of the present invention is to provide a data line driver making it possible to diminish a picture-frame space while realizing prevention of deterioration of liquid crystal and a better display with suppressed flickers.

Another object of the present invention is to provide a data line driver making it possible to reduce the difference between gray-scale level voltages of opposite polarities corresponding to the same gray-scale level, and to eventually realize a multigray-scale display of high quality.

According to the fundamental aspect of the present invention, there is provided a digital data line driver for driving data lines arranged on a liquid-crystal panel. The data line driver including: a data input circuit for fetching data in response to an external clock; a reference voltage circuit having reference voltages corresponding to a plurality of gray-scale levels; a selector circuit for selecting a specified reference voltage representing the data from among those of the reference voltage circuit; and an output circuit for outputting the reference voltage selected by the selector as display data onto the data lines.

Herein, the data input circuit and said output circuit have a data-crossing function for switching data between adjoining channels of said data lines according to an external data switching control signal.

In a preferred embodiment of the present invention, switching data between adjoining channels of data lines is effected between adjoining odd and even channels of data lines. In this case, the reference voltage circuit includes first and second reference voltage circuits. One of the circuits is assigned to odd channels, and the other circuit is assigned to even channels.

According to the foregoing configuration of the data line driver of the present invention, the data-crossing function for switching data between adjoining channels is implemented in each of the data input circuit and output circuit. Positive-polarity and negative-polarity driving voltages can therefore be output alternately to a data line of the same channel. In other words, alternating drive can be attained readily. This makes it possible to prevent deterioration of liquid crystal.

Moreover, the first and second reference voltage circuits for generating gray-scale level voltages are assigned to the odd channels of data lines and the even channels of data lines respectively. For example, when the first reference voltage circuit is set to positive voltage and the second reference voltage circuit is set to negative voltage, driving voltages of different polarities can be output simultaneously onto data lines of adjoining channels. In other words, vertical line inversion drive can be attained. This makes it possible to suppress flickers in a screen and eventually realize a better display.

Furthermore, since the reference voltage circuits are dedicated to the odd channels of data lines and the even channels of data lines respectively, vertical line reversal drive can be realized in a single bank driving mode without, unlike in a known driver, the necessity of increasing the number of reference voltages or analog switches. This makes it possible to reduce the scale of the gray-scale level voltage generation circuit or selector circuit in the driver, and eventually reduce the picture-frame space.

According to another embodiment of the present invention, there is provided a data line driver in which the first and second reference voltage circuits in the aforesaid data line driver include first and second gray-scale level voltage generation circuits each of which generates reference voltages corresponding to a plurality of gray-scale levels using a plurality of reference voltages, and the selector circuit therein includes first and second groups of gray-scale level voltage lines for transmitting a plurality of gray-scale level voltages generated by the first and second gray-scale level generation circuits to the associated odd channels and even channels. Herein, gray- scale level voltage lines of the first and second groups, which are associated with the same gray-scale levels, are juxtaposed in pairs and arranged alternately in order of gray-scale level voltage.

According to the foregoing configuration, the gray-scale level voltage lines of the first and second groups, which are associated with the same gray-scale levels, are juxtaposed in pairs and arranged alternately in order of gray-scale level voltage. For example, when the first group of gray-scale level voltage lines is assigned to positive voltage and the second group of gray-scale level voltage lines is assigned to negative voltage, the relative positions of positive and negative voltage lines associated with the same gray-scale level can be approximated. As a result, a difference in length between positive and negative output lines gets smaller and a difference in line resistance gets smaller.

Consequently, a difference between positive-polarity and negative-polarity voltages to be applied to pixels during the same time interval can be reduced (See FIGS. 15A and 15B). A difference between gray-scale level voltages of opposite polarities corresponding to the same gray-scale level can therefore be diminished. This contributes to realization of multigray-scale display of better quality.

Moreover, as mentioned above, the first and second groups of gray-scale level voltage lines are arranged in specific form. Useless unoccupied spaces which are observed in the known driver (See FIG. 4) can be eliminated. This contributes to a reduction in size of a chip when the driver is realized in the form of an IC.

BRIEF DESCRIPTION OF THE DRAWINGS

Other objects and features of the present invention will be described hereinafter in detail by way of preferred embodiments with reference to the accompanying drawings, in which:

FIG. 8 is a diagram showing the relationship between various control signals and data items in the circuit shown in FIG. 7;

DESCRIPTION OF THE PREFERRED EMBODIMENTS

Figure 6:
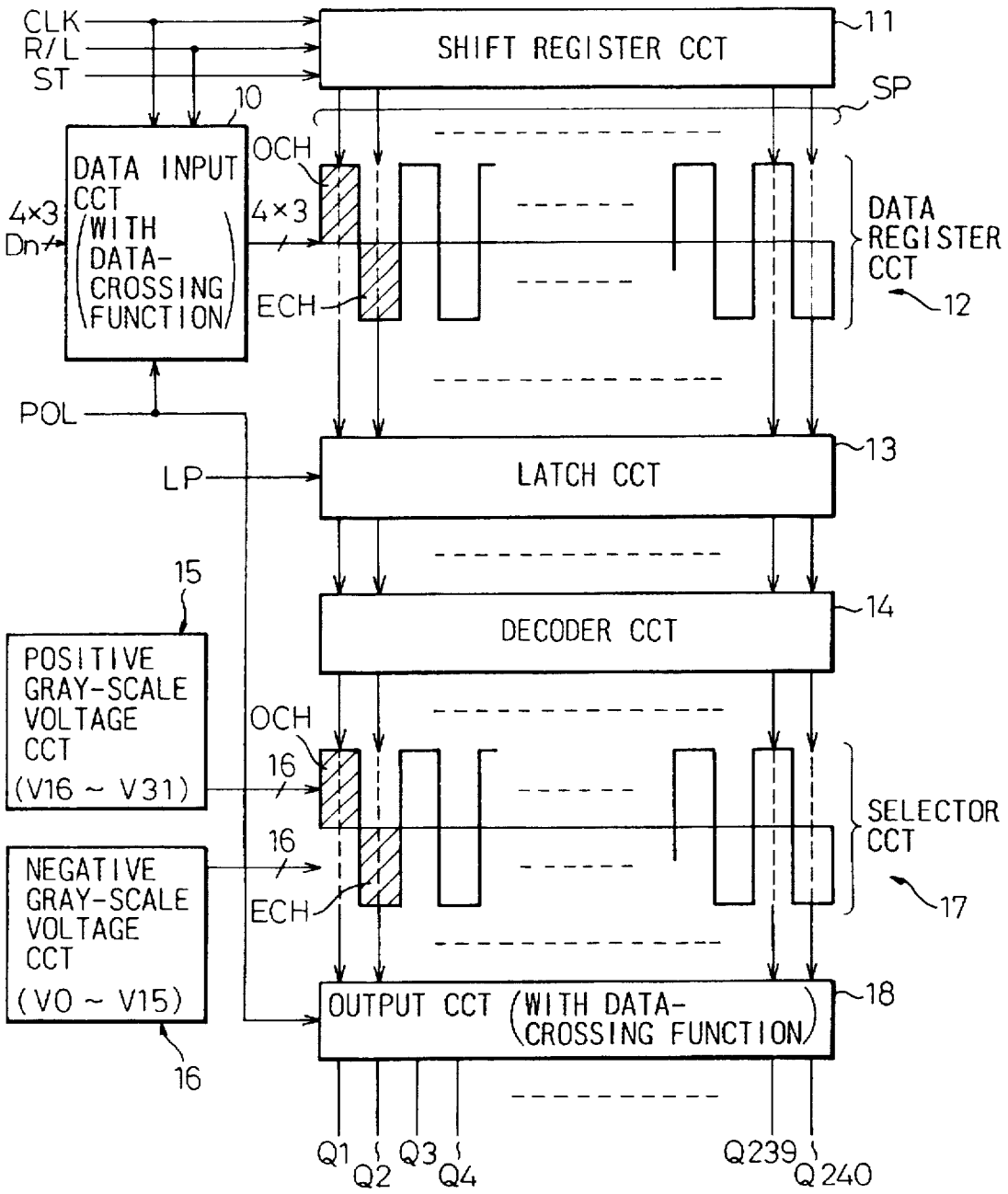
FIG. 6 is a block diagram showing the configuration of a data line driver for an LCD in accordance with the first embodiment of the present invention.

FIG. 6 shows the configuration of a data line driver for an LCD in accordance with the first embodiment of the present invention.

Figure 1:
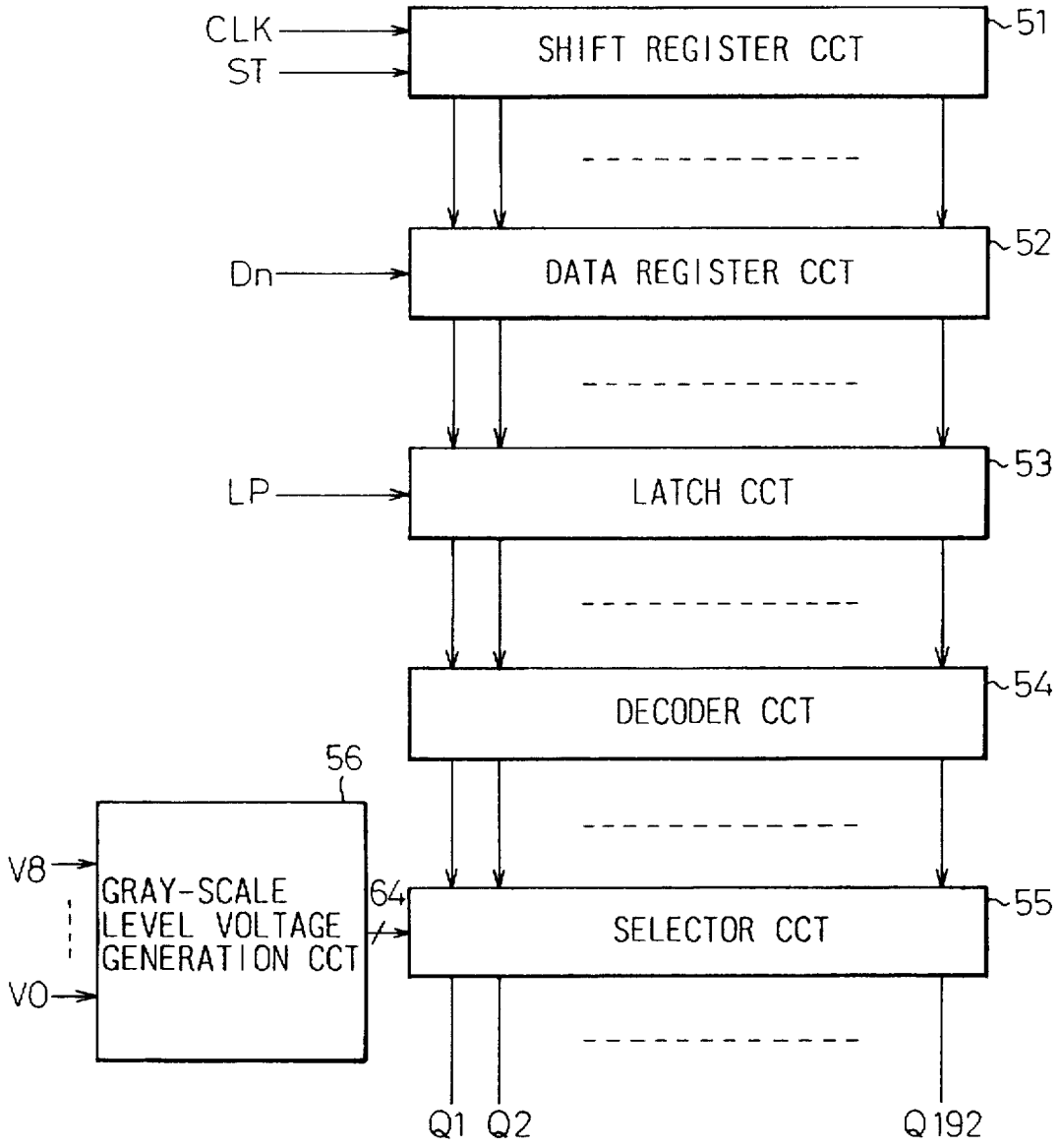
FIG. 1 is a block diagram showing the configuration of a typical data line driver.

This embodiment is a digital data line driver permitting 16 gray-scale levels. The basic configuration is identical to that of the data line driver shown in FIG. 1. The description of the basic configuration will therefore be omitted.

The constituent features of the data line driver of this embodiment are <1> that a positive reference voltage circuit 15 and negative voltage circuit 16 assigned exclusively to the odd channels OCH of data lines and the even channels ECH of data lines in advance are included as a gray-scale level voltage generation circuit, and <2> that a data-crossing function for switching data between adjoining channels on the basis of a data switching control signal POL applied externally to the driver is implemented in each of a data input circuit 10 and output circuit 18.

In this embodiment, the positive and negative voltage circuits 15 and 16 output sixteen reference voltages V16 to V31 and V0 to V15 respectively as 16 gray-scale level voltages directly to gray-scale level voltage lines linked to the associated odd channels and even channels in a selector circuit 17. One of the 16 gray-scale level voltages is selected and output by an associated analog switch in the selector 17 according to the result of decoding performed by a decoder circuit 14.

A signal R/L input to the data input circuit 10 and shift register circuit 11 is a control signal for use in switching directions of shifting data. A signal SP output from the shift register circuit 11 is a signal for use in controlling the timing of data fetching performed by a data register circuit 12.

Figure 7:
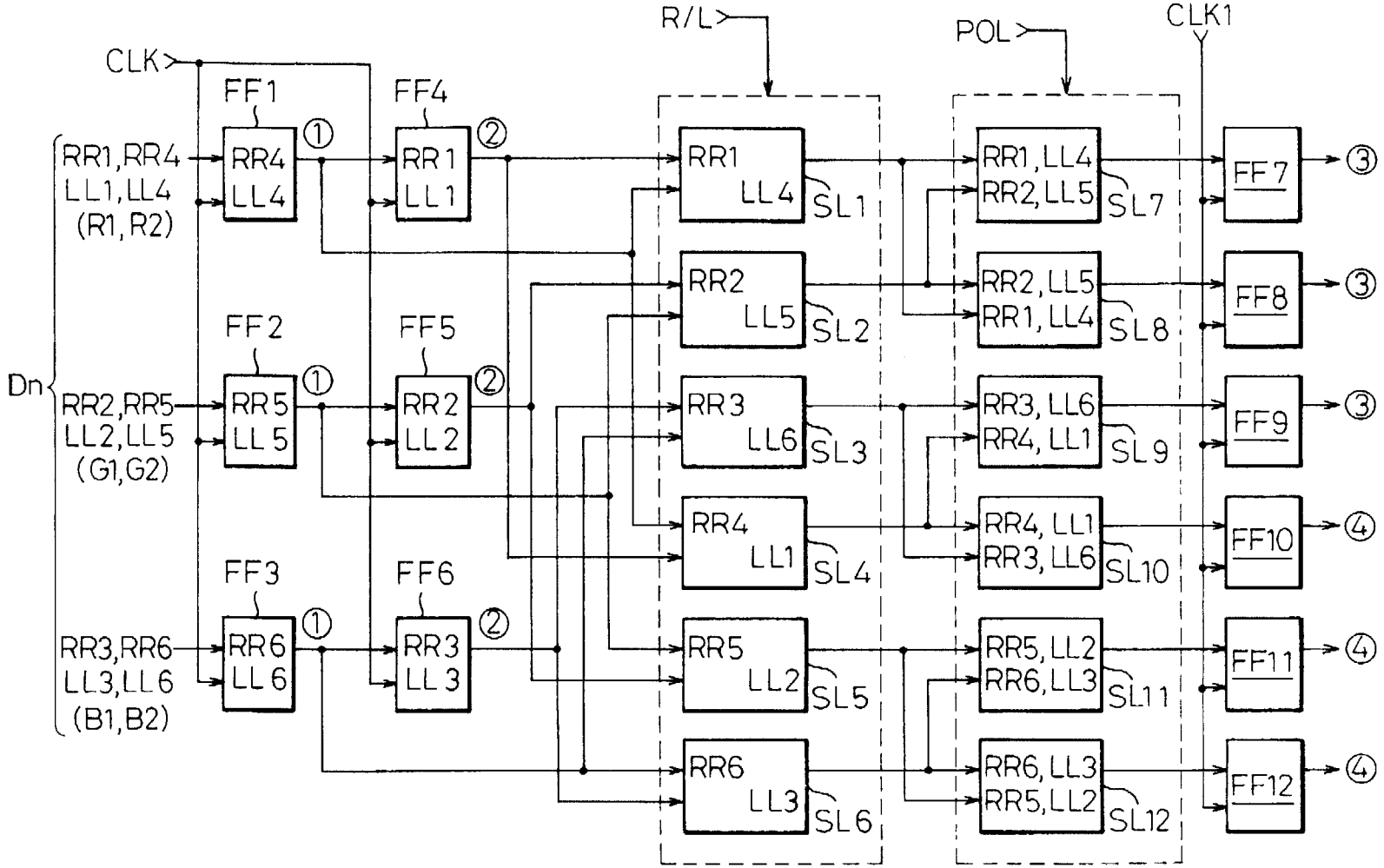
FIG. 7 is a block diagram showing the circuitry of a data input circuit shown in FIG. 6.

FIG. 7 shows the circuitry of the data input circuit 10.

The illustrated circuit is an example of the configuration adopted when a data-crossing function is effected for each data bit and an example of the configuration usable when data is shifted to either the right or left. In the drawing, FF1 to FF6 denote flip-flops responsive to a clock CLK, FF7 to FF12 denote flip-flops responsive to a clock CLK1 (a clock whose frequency is ½ of that of the clock CLK). SL1 to SL6 denote selectors responsive to a shifting direction switching control signal R/L. SL7 to SL12 denote selectors responsive to a data switching control signal POL. The relationships between data items <3> and <4> output from the flip-flops FF7 to FF12 in the last stage and the control signals and R/L and POL are as shown in FIG. 8.

Figure 9:
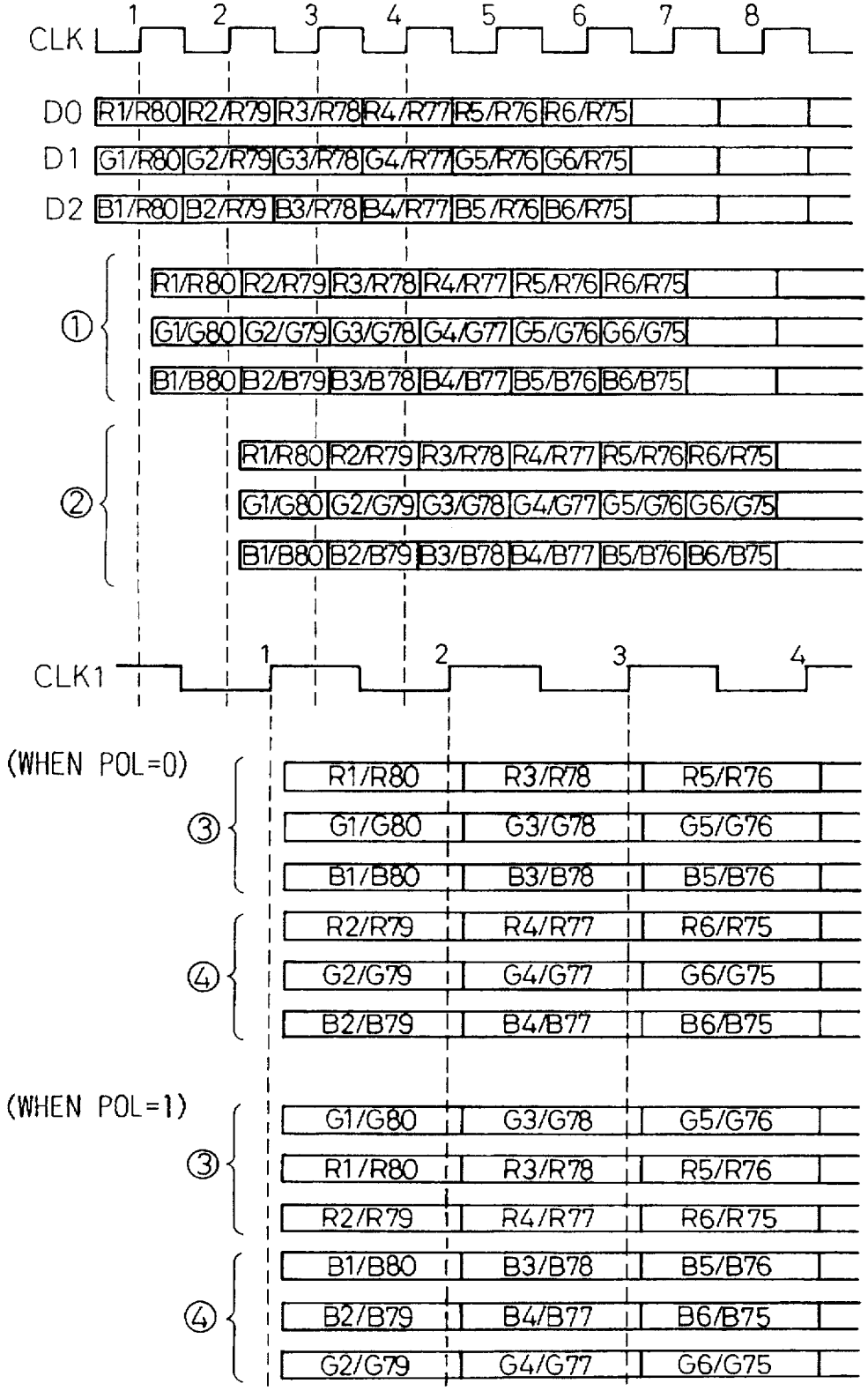
FIG. 9 is an operation timing chart concerning the circuit shown in FIG. 7.

FIG. 9 shows an example of the timing of operations of the data input circuit 10.

In the drawing, R1, R2, etc., and R80 denote input data; that is, first-clock red (hereinafter R) data, second-clock R data, etc., and 80-clock R data. The same applies to green (hereinafter G) data G1, G2, etc., and G80, and to blue (hereinafter B) data B1, B2, etc., and B80. In the example of FIG. 9, data synchronous with 80 clock pulses are input by each of R, G, and B systems, and a total of 240 outputs are provided.

First, data fetched synchronously with the clock CLK pass through the flip-flops FF1 to FF6 in the first stage. At this time, the relative timing of the data is illustrated at <1> in the operation timing chart. After passing the flip-flops FF7 to FF12 in the second stage, the relative timing of the data becomes as illustrated at <2>. Six data whose relative timing is adjusted according the timing <1> and <2> are selected with the shifting direction switching control signal R/L and data switching control signal POL by the selectors SL1 to SL12. The selected data are fetched by the flip-flops FF7 to FF12 in the last stage synchronously with the timing of the clock CLK1 (See <3> and <4> in the operation timing chart), and then sent to the data register circuit 12 (See FIG. 6).

At this time, as shown in FIG. 8, outputs of adjoining channels are switched alternately according to the level (1 or 0) of the data switching control signal POL.

Figure 10:
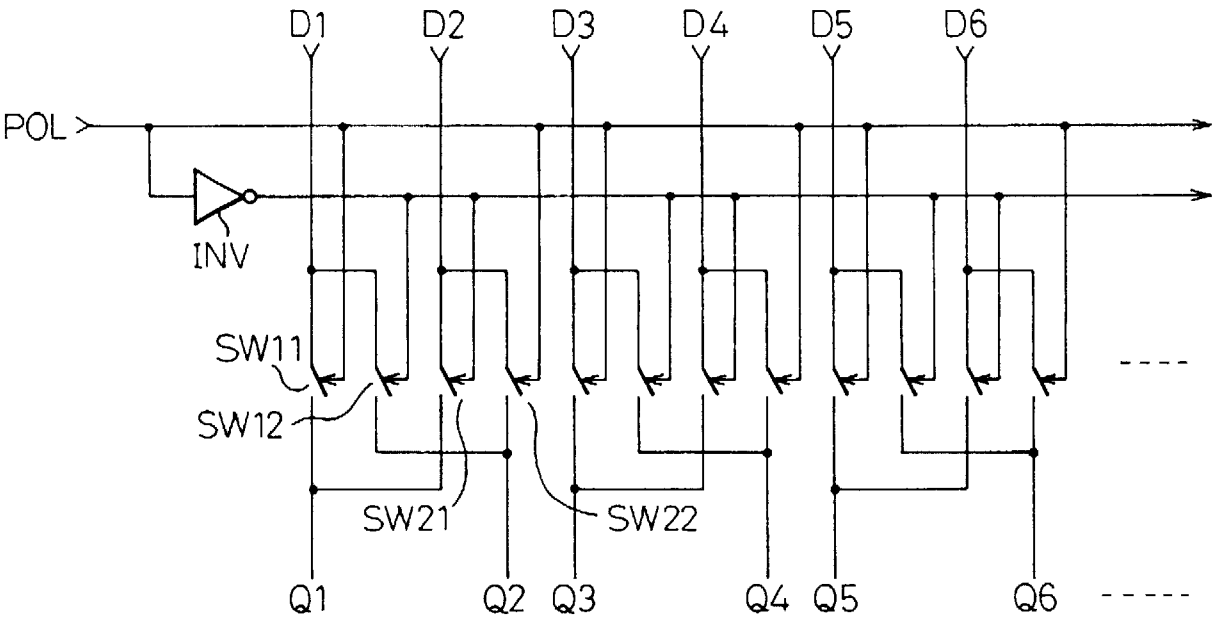
FIG. 10 is a diagram showing the circuitry of an output circuit shown in FIG. 6.

FIG. 10 shows the circuitry of the output circuit 18.

This circuit comprises an inverter INV responsive to the data switching control signal POL, and switches for determining whether data supplied from the selector circuit 17 to adjoining channels are output to the channels as they are or after they are switched. For example, data D1 and D2 are handled by a unit including a switch SW11 for sending the data D1 to an associated channel (data line Q1) in response to the data switching control signal POL, a switch SW12 for sending the data D1 to an adjoining channel (data line Q2) in response to an output of the inverter INV, a switch SW21 for sending the data D2 to the adjoining channel (data line Q1) in response to an output of the inverter INV, and a switch SW22 for sending the data D2 to the associated channel (data line Q2) in response to the data switching control signal POL.

As mentioned above, according to this embodiment, the data input circuit 10 and output circuit 18 switch data between adjoining channels in response to the data switching control signal POL. Positive-polarity and negative-polarity driving voltages can therefore be output alternately to a data line of the same channel. In short, alternating drive can be attained. Deterioration of the liquid crystal can therefore be prevented. This is effective in extending the service life of the liquid crystal.

Moreover, the positive and negative voltage circuits 15 and 16 for generating gray-scale level voltages are assigned to the odd channels OCH of data lines and even channels ECH of data lines respectively. Driving voltages of different polarities can therefore be output simultaneously to data lines of adjoining channels. In short, vertical line reversal drive can be attained. Flickers in a screen can therefore be suppressed. This contributes to realization of a better display.

Furthermore, the reference voltage circuits 15 and 16 are assigned exclusively to the odd channels OCH and even channels ECH respectively. Vertical line inversion drive can therefore be attained in single bank driving mode without, unlike in the known driver, the necessity of increasing reference voltages or analog switches. In other words, since single bank driving can be achieved, it becomes possible to reduce the picture-frame space.

Figure 11:
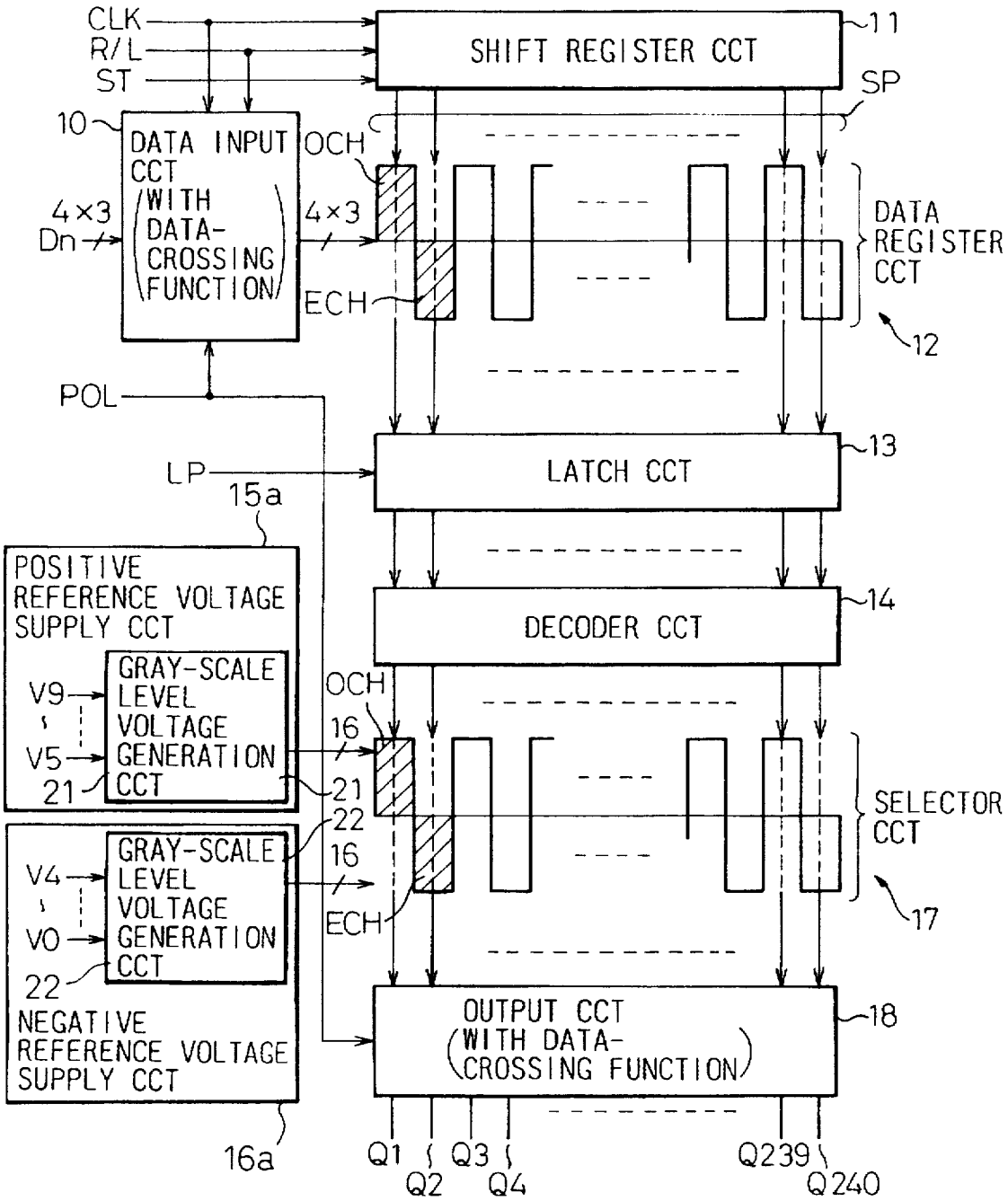
FIG. 11 is a block diagram showing the configuration of a data line driver for an LCD in accordance with the second embodiment of the present invention.

FIG. 11 shows the configuration of a data line driver for an LCD in accordance with the second embodiment of the present invention.

A data line driver in accordance with this embodiment is different from the aforesaid one of the first embodiment in that gray-scale level voltage generation circuits 21 and 22 are incorporated in the positive and negative reference voltage circuits 15*a* and 16*a*. The other components are identical to those of the first embodiment. The description of the components will therefore be omitted.

Figure 2:
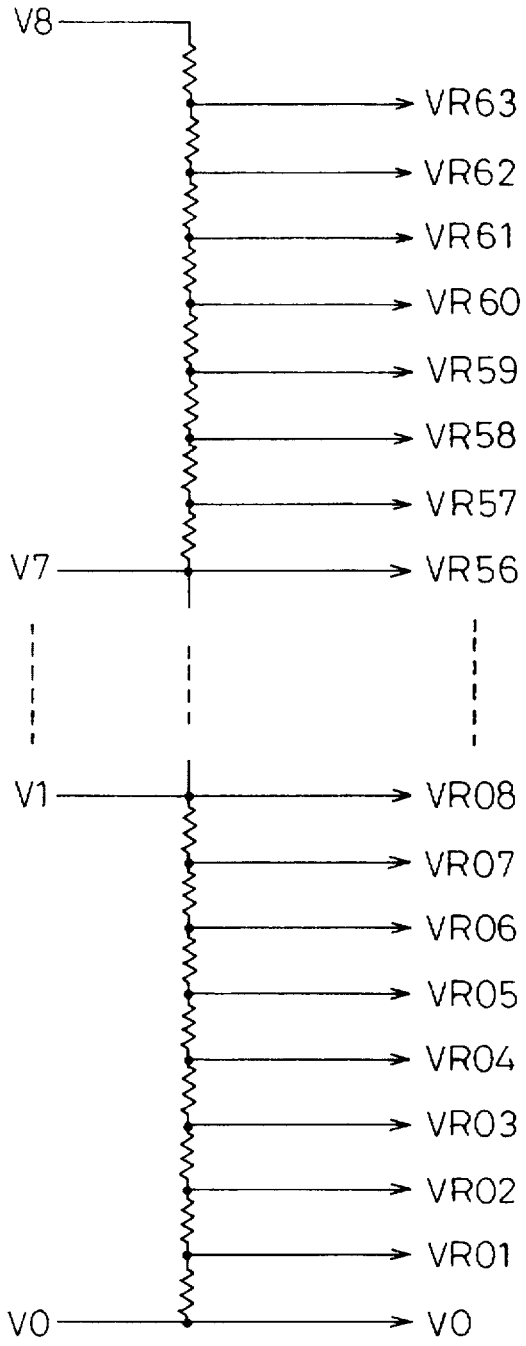
FIG. 2 is a diagram showing the circuitry of a gray-scale level voltage generation circuit shown in FIG. 1.
Figure 3A:
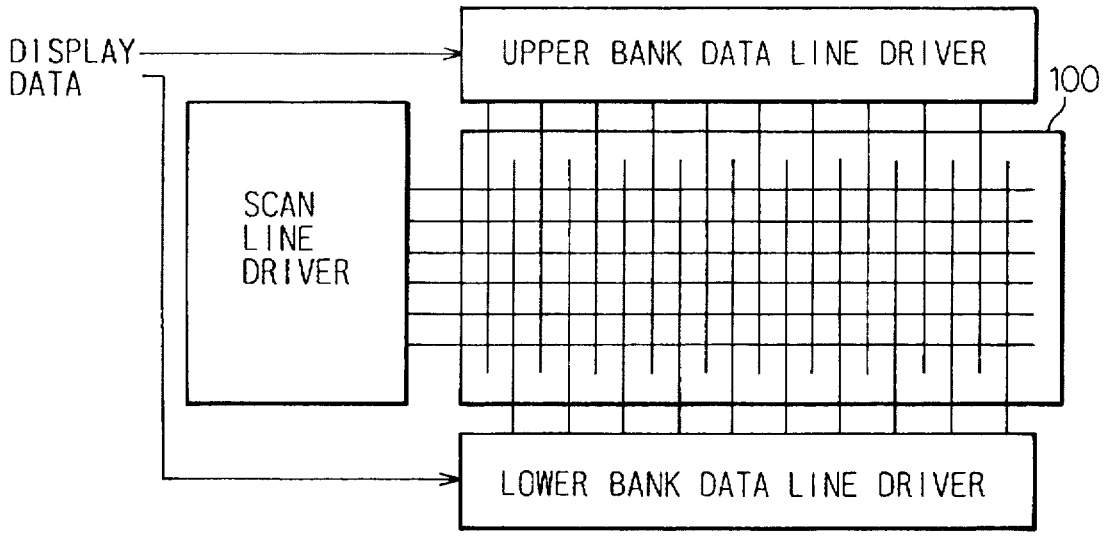
FIGS. 3A and 3B are diagrams showing locations (or a location) of data line drivers (or a data line driver) relative to a liquid crystal panel.
Figure 3B:
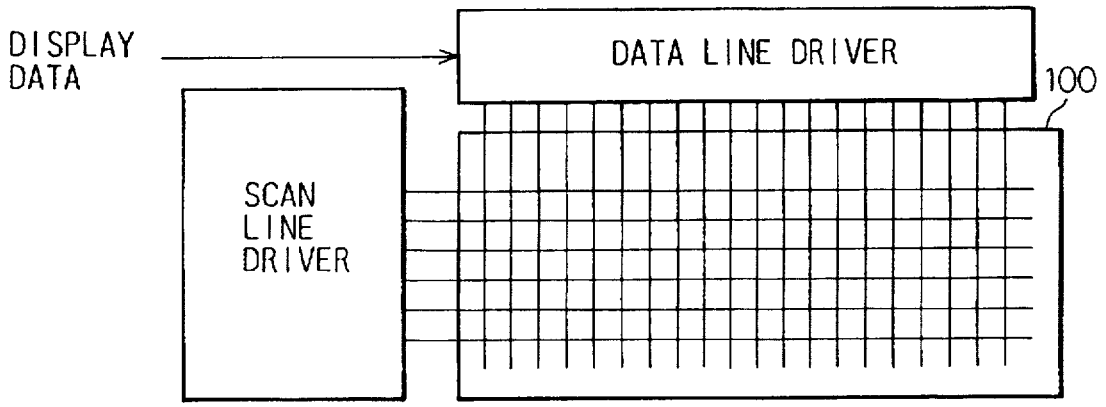

The positive and negative gray-scale level voltage generation circuits 21 and 22 can be configured in the form of a resistor array type D/A converter as, for example, shown in FIG. 2. In this embodiment, the gray-scale level voltage generation circuits 21 and 22 in the positive and negative reference voltage circuits 15*a* and 16*a* generate reference voltages corresponding to 16 gray-scale levels using five reference voltages V5 to V9 and V0 to V4 respectively. The generated 16 gray-scale level voltages are output to gray-scale level voltage lines linked to the associated odd channels or even channel in the selector 17. One of each set of the voltages is selected and output by an associated analog switch in the selector 17 according to the result of decoding performed by the decoder circuit 14.

According to the second embodiment, in addition to the aforesaid effect exerted by the first embodiment (See FIG. 6), there is provided the advantage that the number of input reference voltages sent externally can be made smaller than that in the first embodiment.

Figure 12:
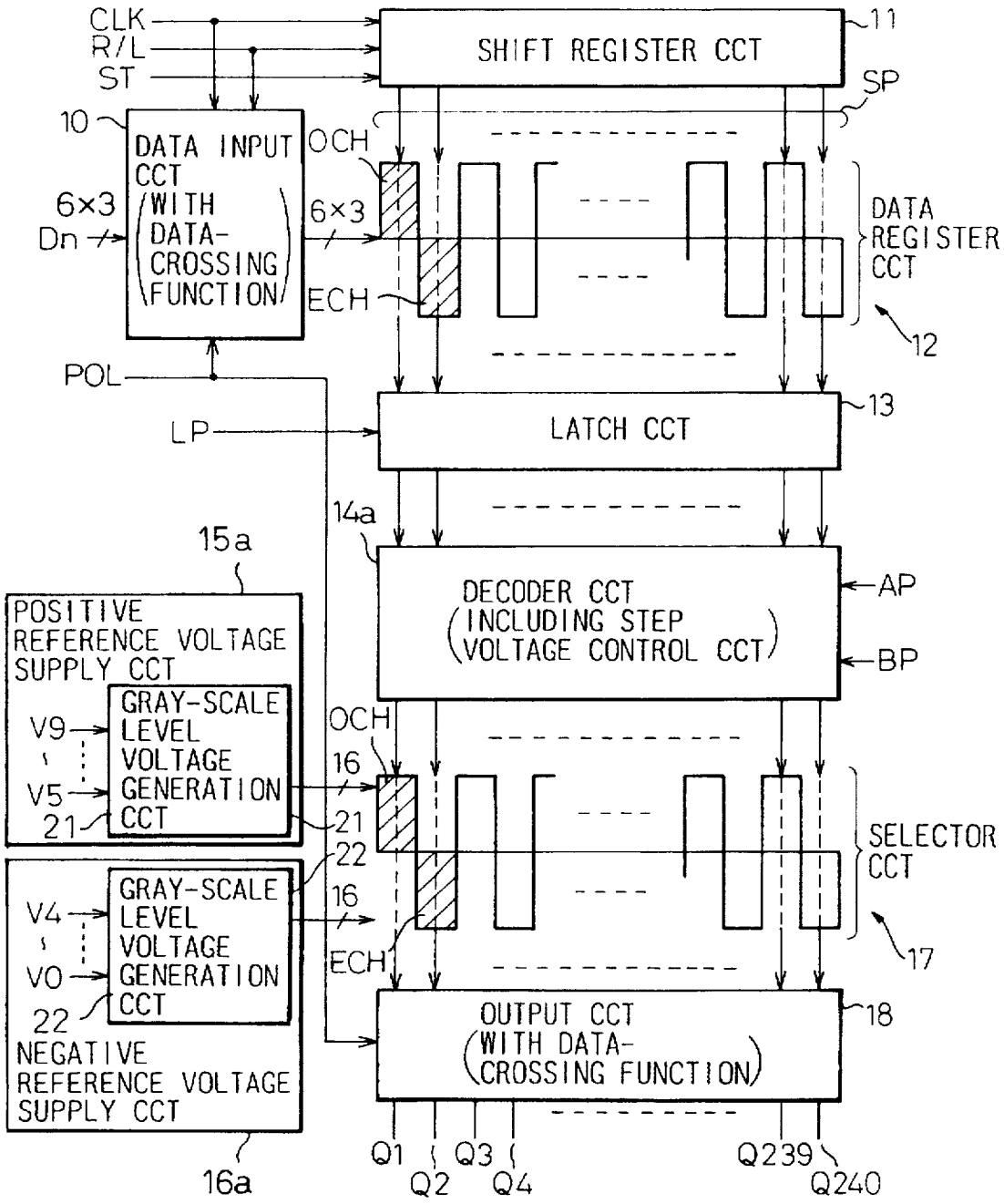
FIG. 12 is a block diagram showing the configuration of a data line driver for an LCD in accordance with the third embodiment of the present invention.

FIG. 12 shows the configuration of a data line driver for an LCD in accordance with the third embodiment of the present invention.

A data line driver in accordance with this embodiment is different from the aforesaid one of the second embodiment (See FIG. 11) in a point that a step voltage control circuit is incorporated in a decoder circuit 14*a*. The other components are identical to those of the second embodiment. The description of the components will be omitted.

The step voltage control circuit in the decoder circuit 14*a* has the ability to output a step voltage control signal indicating 4 gray-scale levels on the basis of 2-bit data out of 6-bit data input from the data input circuit 10 via the data register circuit 12 and latch circuit 13, and control signals AP and BP supplied externally. The third embodiment is characterized in that the selector circuit 17 superposes a step voltage generated on the basis of the step voltage control signal on 16 gray-scale level voltages generated by each of the positive and negative gray-scale level voltage generation circuits 21 and 22.

Figure 13A:
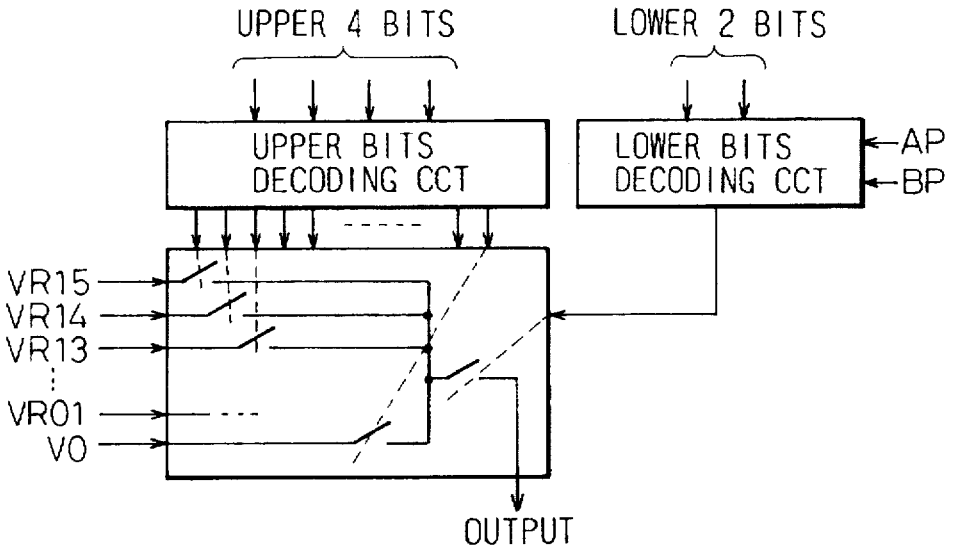
FIGS. 13A, 13B and 13C are explanatory diagrams concerning gray-scale control in the third embodiment.
Figure 13B:
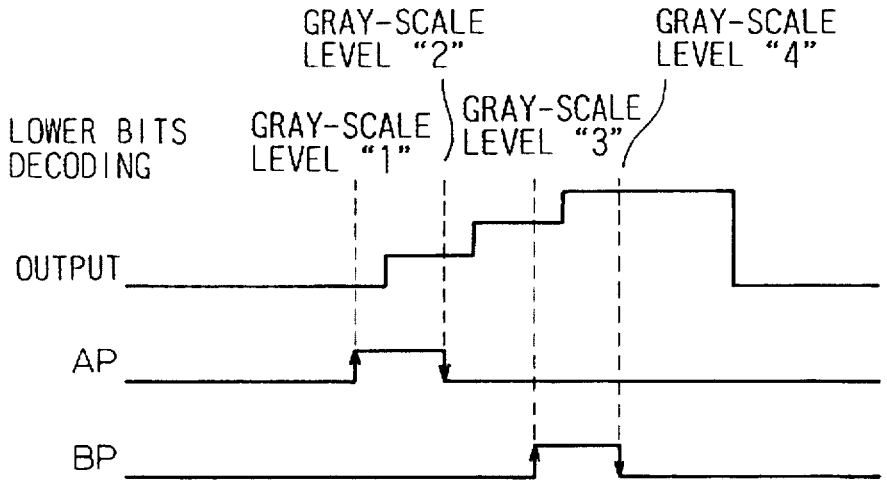
Figure 13C:
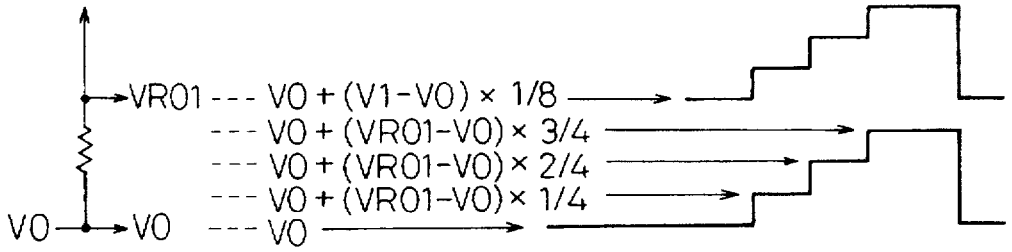

FIGS. 13A, 13B and 13C show the principle of gray-scale control in this embodiment. As shown in FIG. 13A, in the decoder circuit, an upper-bits decoding circuit decodes upper 4 bits of 6-bit data supplied from the latch circuit and selects one of 16 gray-scale level voltages V0, and VR01 to VR15. On the other hand, a lower-bits decoding circuit decodes data of lower 2 bits and produces the step voltage control signal indicating 4 gray-scale levels using the control signals AP and BP (See FIG. 13B). Based on the step voltage control signal, a step voltage is produced (See FIG. 13C). The step voltage is superposed on each of the 16 gray-scale level voltages V0, and VR01 to VR15. Thus, display of 64 gray-scale levels (=16×4) can be attained.

According to the third embodiment, in addition to the aforesaid effect exerted by the second embodiment (See FIG. 11), there is provided the advantage that the number of display gray-scale levels can be increased despite the same number of input reference voltages as that in the second embodiment. This is quite effective in realizing a multigray-scale display.

Figure 14:
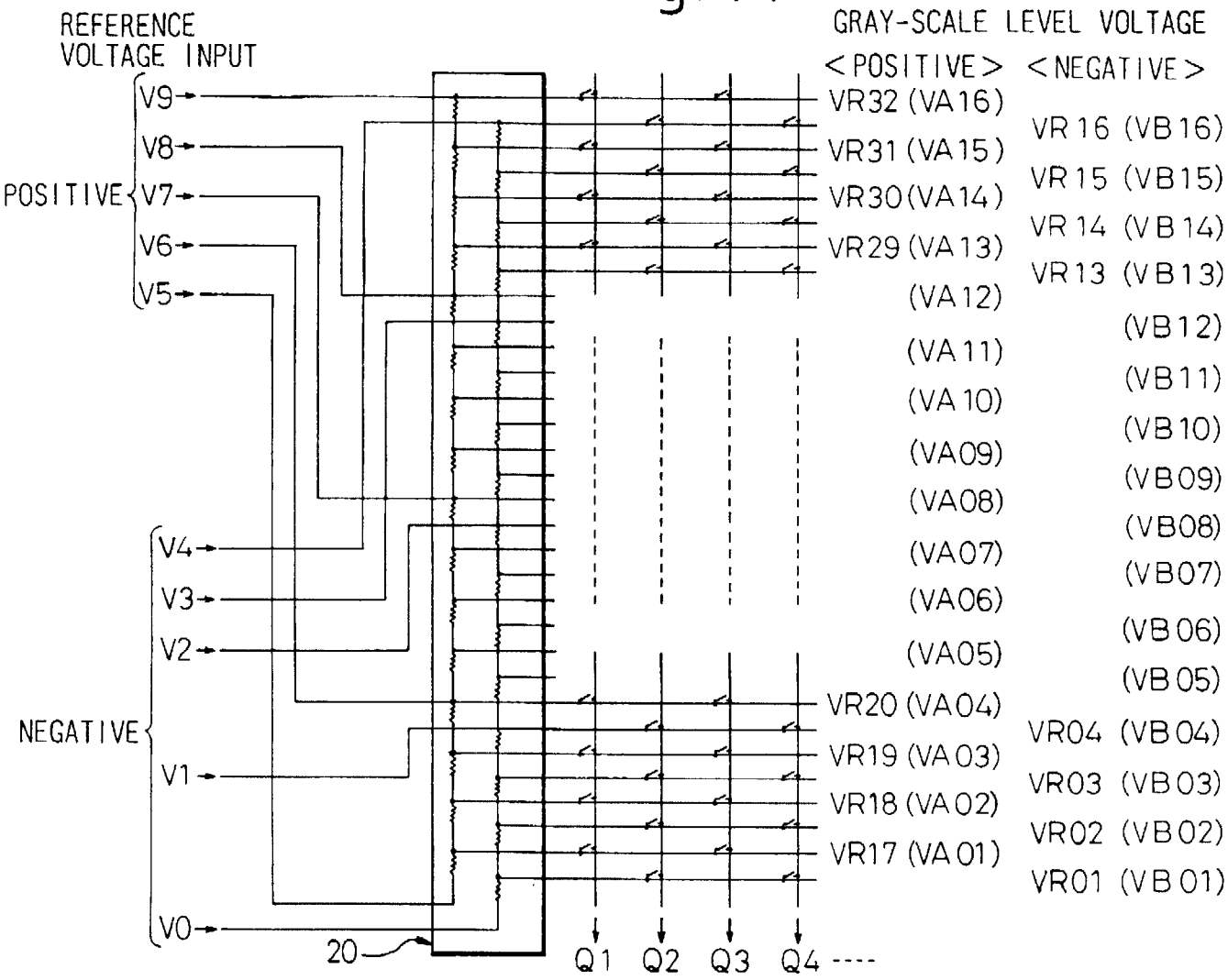
FIG. 14 is a diagram showing the configuration (arrangement of gray-scale level voltage lines) of a major section of a data line driver for an LCD in accordance with the fourth embodiment of the present invention.

FIG. 14 shows the configuration (arrangement of gray-scale level voltage lines) of a major section of a data line driver for an LCD in accordance with the fourth embodiment of the present invention.

In the drawing, reference numeral 20 denotes a gray-scale level voltage generation circuit configured in the form of a resistor array type D/A converter. The gray-scale level voltage generation circuit 20 uses 16 resistors to the lines of reference voltages V5 and V6, etc., and V8 and V9 into four lines respectively and thus produces positive voltages VR17 to VR32 corresponding to 16 gray-scale levels (VA01 to VA16) using the 5 reference voltages V5 to V9 that are input as positive reference voltage. Likewise, the gray- scale level voltage generation circuit 20 uses 16 resistors to tap the lines reference voltages V0 and V1, etc., and V3 and V4 into four lines and thus produces negative voltages VR01 to VR16 corresponding to 16 gray-scale levels (VB01 to VB16) using the five reference voltages V0 to V4 that are input as negative reference voltage. The produced positive voltages corresponding to 16 gray-scale levels, VR17 to VR32, are output onto gray-scale level voltage lines linked to associated odd channels (Q1, Q3, etc.) in the selector circuit. Likewise, the negative voltages corresponding to 16 gray-scale levels, VR01 to VR16, are output onto gray- scale level voltage lines linked to associated even channels (Q2, Q4, etc.) in the selector circuit. One of each set of the voltages is selected by an associated analog switch in the selector circuit.

In the example of FIG. 14, although the gray-scale level voltage generation circuit 20 is configured in the form of one block, it functions in the same manner as the two gray-scale level voltage generation circuits 21 and 22 in the second embodiment (See FIG. 11).

The constituent feature of the fourth embodiment is that positive gray-scale level voltage lines (VR17 to VR32) and negative gray-scale level voltage lines (VR01 to VR16), which are associated with the same gray-scale levels (for example, lines VA16 and VB16, VA15 and VB15, etc.), are juxtaposed in pairs and arranged alternately in order of gray-scale voltage.

Figure 4:
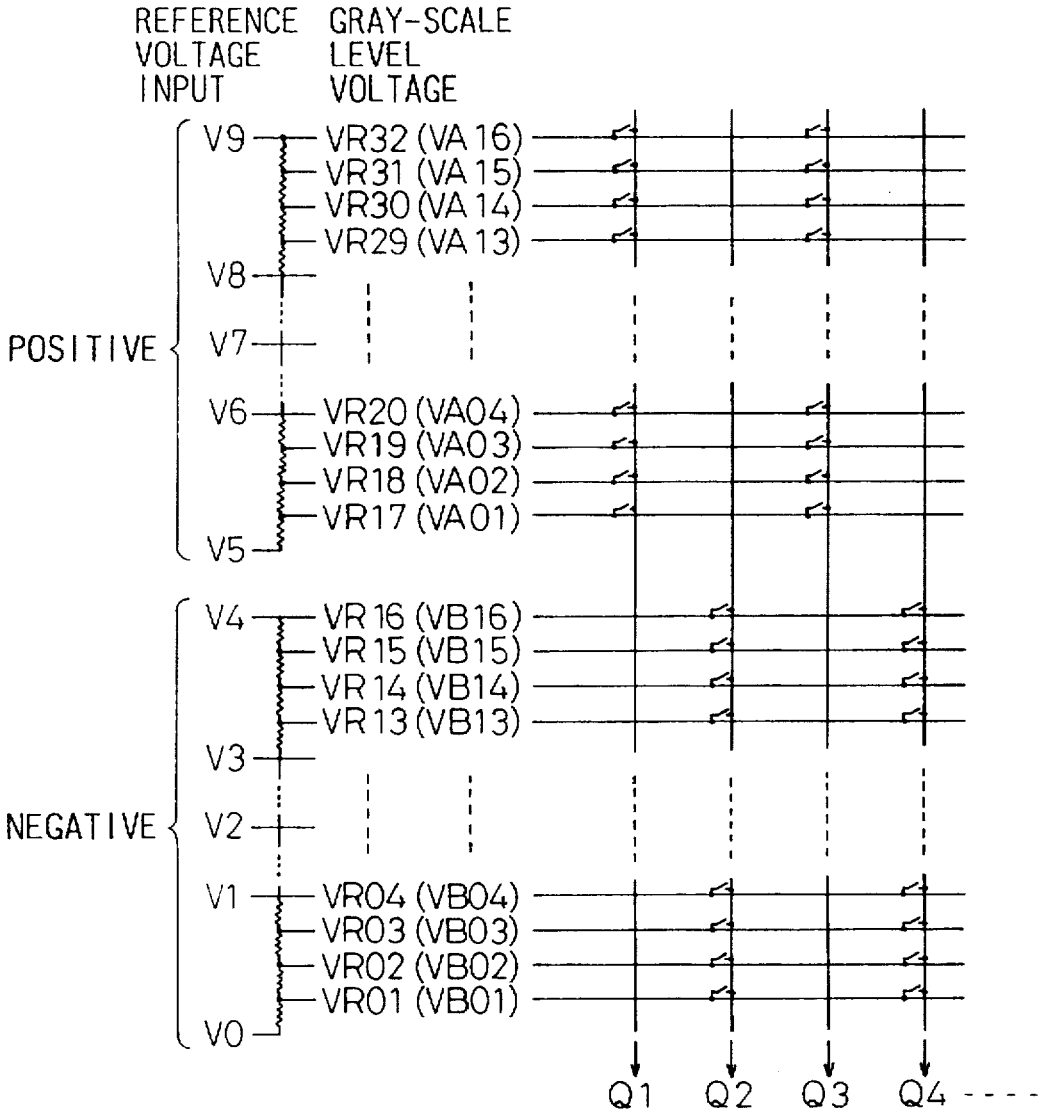
Fig. 4 PRIOR ART
FIG. 4 is a diagram showing the configuration (arrangement of gray-scale level voltage lines) of a major section of a known data line driver for an LCD.
Figure 5A:
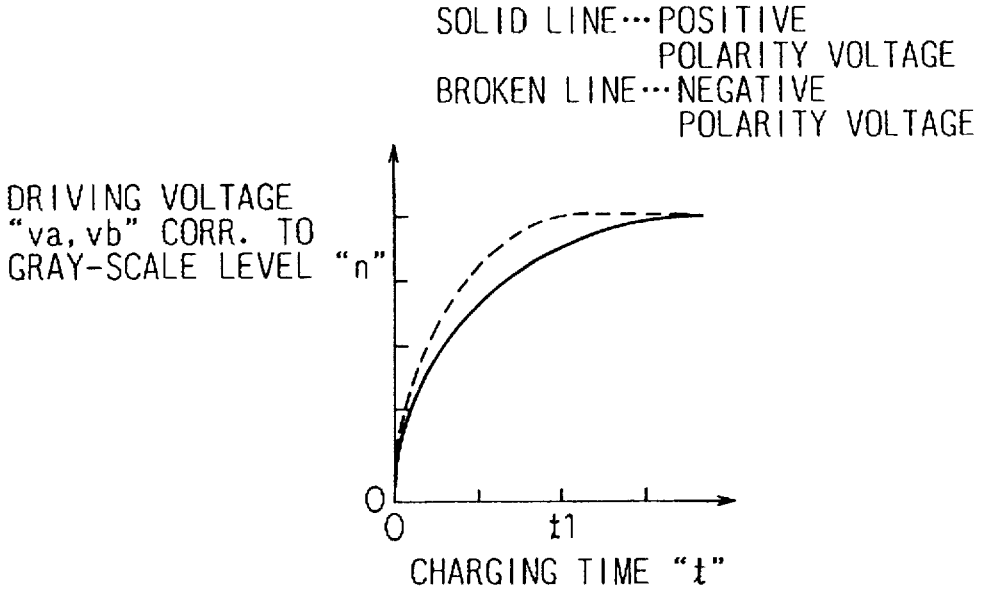
Fig. 5A PRIOR ART
FIGS. 5A and 5B are diagrams showing the relationship between gray-scale levels and pixel charged voltages in the configuration shown in FIG. 4.
Figure 5B:
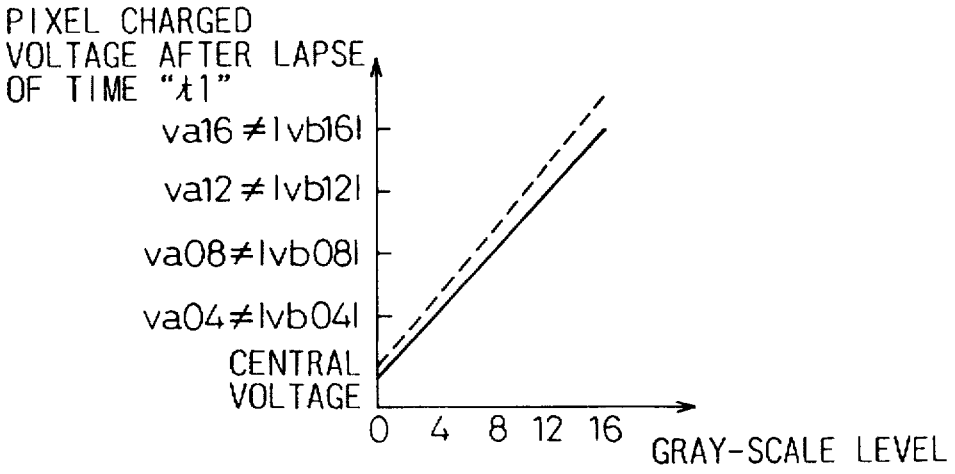
Fig. 5B PRIOR ART

In the known arrangement shown in FIG. 4, the positions of positive and negative voltage lines associated with the same gray-scale level (for example, VA16 and VB16) are separated from each other. In the arrangement in accordance with the fourth embodiment, the positions of positive and negative lines associated with the same gray-scale level (VA16 and VB16) can be set next to each other. As a result, a difference between distances of associated analog switches from output pads; that is, a difference in length between output lines gets smaller and a difference in line resistance between the output lines gets smaller.

Figure 15A:
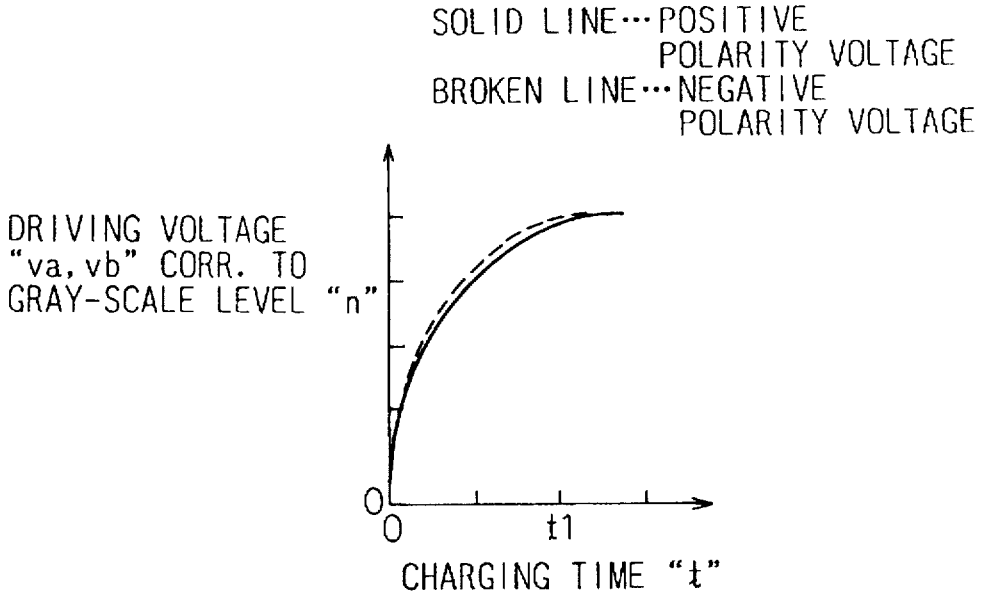
FIGS. 15A and 15B are diagrams showing the relationship between gray-scale levels and pixel charged voltages in the fourth embodiment.
Figure 15B:
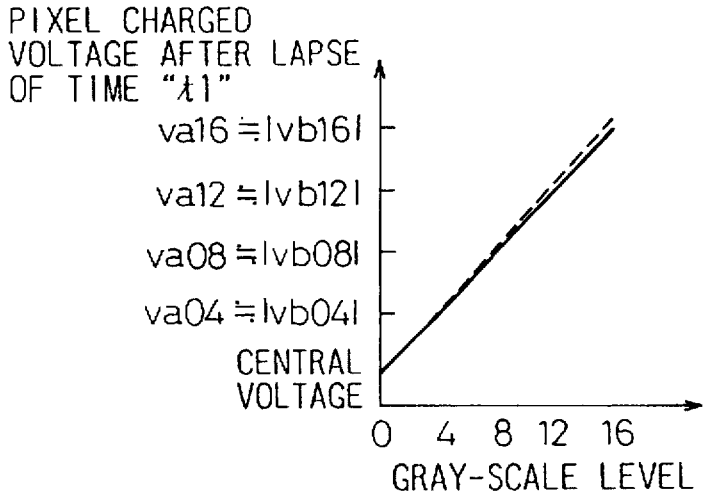

Consequently, as shown in FIGS. 15A and 15B, a difference between positive-polarity and negative-polarity voltages va and vb to be applied to pixels during the same time interval can be made very small (va=vb). This makes it possible to reduce a difference between gray-scale level voltages of opposite polarities corresponding to the same gray-scale level, and eventually to realize a multigray-scale display of better quality.

Moreover, since the groups of positive and negative gray-scale level voltage lines are, as mentioned above, arranged in specific form, useless unoccupied spaces observed in the known driver (See FIG. 4) can be eliminated. This contributes to a reduction in size of a chip when the driver is realized in the form of an IC.

Figure 16:
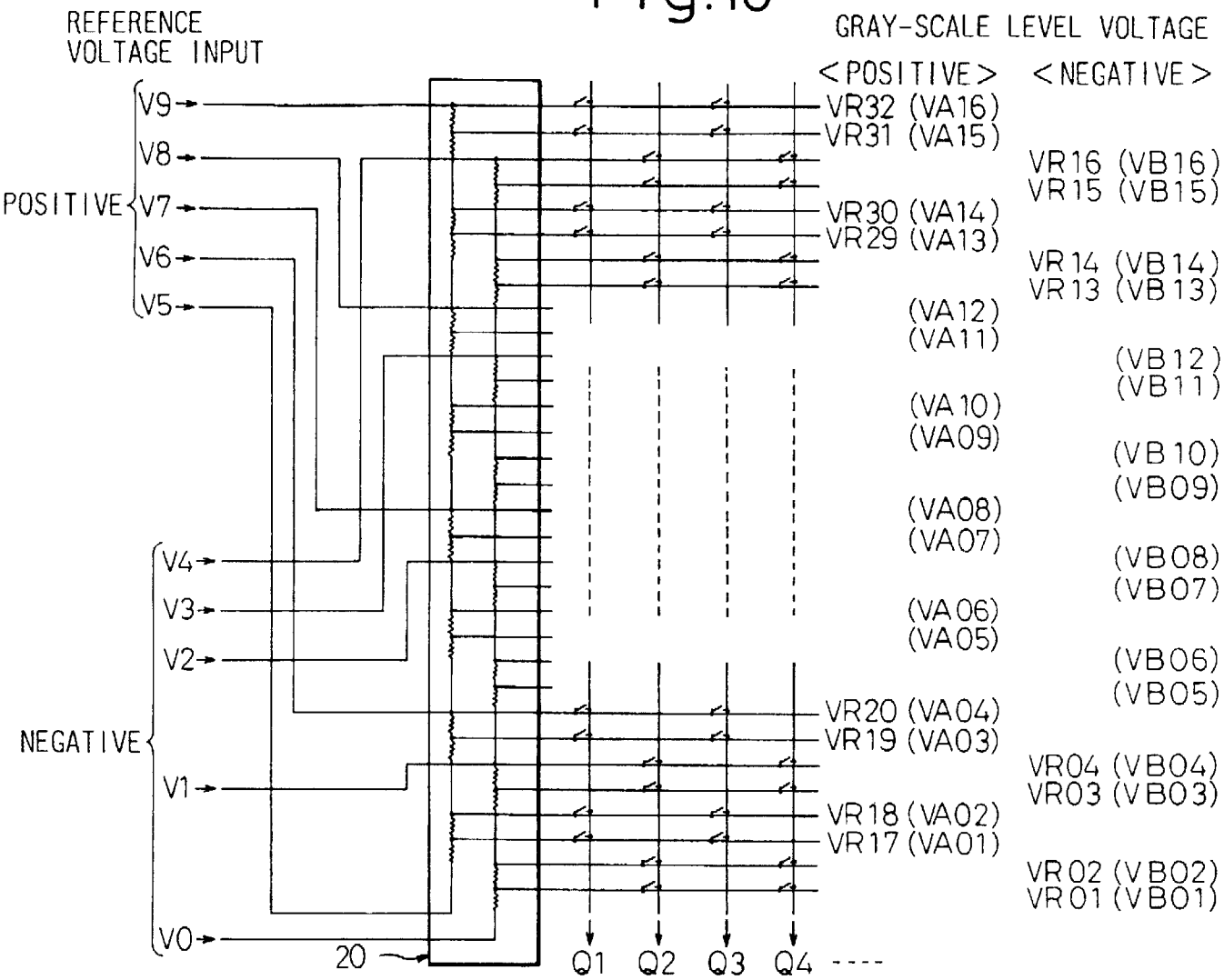
FIG. 16 is a diagram showing the configuration (arrangement of gray-scale level voltage lines) of a major section of a data line driver for an LCD in accordance with the fifth embodiment of the present invention.

FIG. 16 shows the configuration (arrangement of gray-scale level voltage lines) of a major section of a data line driver for an LCD in accordance with the fifth embodiment of the present invention.

The constituent feature of the fifth embodiment is that positive gray-scale level voltage lines (VR17 to VR32) and negative gray-scale level voltage lines (VR01 to VR16), which are associated with the same gray-scale levels, (for example, VA16, VA15, VB16, and VB15, etc.) are juxtaposed two by two and arranged by turns in order of gray-scale voltage.

According to the fifth embodiment, the same effect as that of the fourth embodiment (See FIG. 14) can be exerted.

In this embodiment, positive and negative voltage lines associated with the same gray-scale levels are juxtaposed two by two. As long as a difference in line resistance between each pair of lines is within a permissible range, the number of positive or negative voltage lines to be combined is not limited to two, but the positive and negative voltage lines can be arranged by turns in units of any number of lines.

Figure 17:
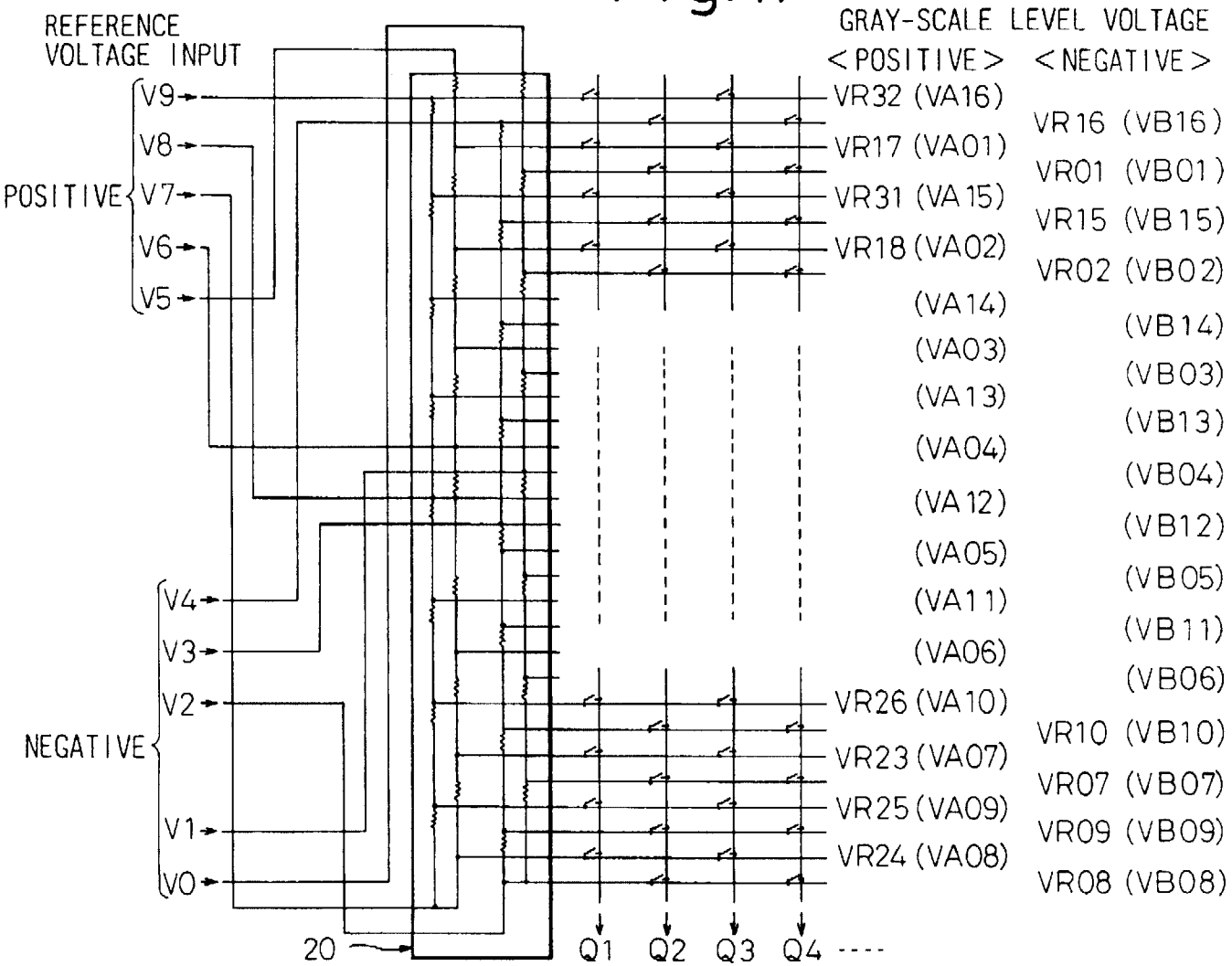
FIG. 17 is a diagram showing the configuration (arrangement of gray-scale level voltage lines) of a major section of a data line driver for an LCD in accordance with the sixth embodiment of the present invention.

FIG. 17 shows the configuration (arrangement of gray-scale level voltage lines) of a major section of a data line driver for an LCD in accordance with the sixth embodiment of the present invention.

The constituent feature of the sixth embodiment is that positive gray-scale level voltage lines (VR17 to VR32) and negative gray-scale level voltage lines (VR01 to VR16) are arranged in the order that lines of the highest voltage level (VR32 and VR16) are succeeded by lines of the lowest voltage levels (VR17 and VR01), lines of the second highest voltage level (VR31 and VR15), lines of the second lowest voltage level (VR18 and VR02), etc., and arranged alternately.

According to the sixth embodiment, in addition to the aforesaid effect exerted by the fourth embodiment, since the lines of the highest and lowest voltage levels corresponding to gray-scale levels of black and white are juxtaposed, there is provided the advantage that influence of a deviation in line resistance can be minimized.

What is claimed is:

1. A digital data line driver for driving data lines arranged on a liquid-crystal panel, said data line driver comprising:

a data input circuit for fetching data in response to an external clock;

a reference voltage supply circuit having reference voltages corresponding to a plurality of gray-scale levels;

a selector circuit for selecting a specified reference voltage representing said data from among those of said reference voltage supply circuit; and an output circuit for outputting said reference voltage selected by said selector circuit as display data onto said data lines;

said data input circuit and said output circuit having a data-crossing function for switching data between different channels of said data lines according to an external data switching control signal.

2. The data line driver according to claim 1, wherein switching data between different channels of said data lines is effected between adjoining odd and even channels of said data lines.

3. The data line driver according to claim 2, wherein said reference voltage supply circuit includes first and second reference voltage supply circuits, one of said first and second reference voltage supply circuits is assigned to odd channels, and the other circuit is assigned to even channels.

4. The data line driver according to claim 3, wherein said first and second reference voltage supply circuits output said reference voltages corresponding to a plurality of gray-scale levels directly onto gray-scale level voltage lines linked to associated odd channels and even channels in said selector circuit.

5. The data line driver according to claim 3, wherein said first and second reference voltage supply circuits include first and second gray-scale level voltage generation circuits each of which generates reference voltages corresponding to said plurality of gray-scale levels using a plurality of reference voltages, and output a plurality of generated gray-scale level voltages onto gray-scale level voltage lines linked to associated odd channels and even channels in said selector circuit.

6. The data line driver according to claim 5, wherein said decoder circuit includes a step voltage control circuit for outputting a step voltage control signal indicating a plurality of gray-scale levels on the basis of data, which is a given number of bits long, that is input from said data input circuit via said register circuit and said latch circuit, and of control signals supplied externally, and said selector circuit superposes a step voltage selected according to said step voltage control signal on said plurality of gray-scale level voltages generated by said first and second gray-scale level voltage generation circuits.

7. The data line driver according to claim 5, wherein said selector circuit includes first and second groups of gray-scale level voltage lines for transmitting said plurality of gray-scale level voltages generated by said first and second gray-scale level voltage generation circuits respectively to associated odd channels and even channels respectively, and gray-scale level voltage lines of said first and second groups, which are associated with the same gray-scale levels, are juxtaposed in pairs and arranged alternately in order of gray-scale level voltage.

8. The data line driver according to claim 5, wherein said selector circuit includes first and second groups of gray-scale level voltage lines for transmitting said plurality of gray-scale level voltages generated by said first and second gray-scale level voltage generation circuits respectively to associated odd channels and even channels respectively, and gray-scale level voltage lines of said first and second groups, which are associated with the same gray-scale levels, are juxtaposed in units of a plurality of lines and arranged by turns in order of gray-scale level voltage.

9. The data line driver according to claim 5, wherein said selector circuit includes first and second groups of gray-scale level voltage lines for transmitting said plurality of gray-scale level voltages generated by said first and second gray-scale level voltage generation circuits respectively to associated odd channels and even channels respectively, and gray-scale level voltage lines of said first and second groups are arranged in the order that lines of the highest voltage level are succeeded by lines of the lowest voltage level, lines of the second highest voltage level, lines of the second lowest voltage level, etc., and said gray-scale level voltage lines of said first and second groups are arranged alternately.

10. A liquid-crystal display device comprising:

a liquid-crystal panel; and a digital data line driver located on one side of said liquid-crystal panel and designed for driving data lines arranged on said liquid-crystal panel;

said data line driver including:

a data input circuit for fetching data in response to an external clock;

a reference voltage supply circuit having reference voltages corresponding to a plurality of gray-scale levels;

a selector circuit for selecting a specified reference voltage representing said data from among those of said reference voltage supply circuit; and an output circuit for outputting said reference voltage selected by said selector circuit as display data onto said data lines;

said data input circuit and said output circuit having a data-crossing function for switching data between different channels of said data lines according to an external data switching control signal.

* * * * *